US009875730B2

(12) United States Patent
Cannon

(10) Patent No.: US 9,875,730 B2
(45) Date of Patent: Jan. 23, 2018

(54) DUAL ACTION PEDAL DEVICE

(71) Applicant: Craig Dean Cannon, Millsboro, DE (US)

(72) Inventor: Craig Dean Cannon, Millsboro, DE (US)

( * ) Notice: Subject to any disclaimer, the term of this patent is extended or adjusted under 35 U.S.C. 154(b) by 0 days.

(21) Appl. No.: 14/999,670

(22) Filed: Jun. 13, 2016

(65) Prior Publication Data

US 2017/0358282 A1 Dec. 14, 2017

(51) Int. Cl.
*G10D 13/00* (2006.01)
*G10D 13/06* (2006.01)

(52) U.S. Cl.
CPC ..... *G10D 13/006* (2013.01); *G10D 13/065* (2013.01)

(58) Field of Classification Search
CPC .. G10D 13/006; G10D 13/065; G10D 13/026; G10D 13/00
USPC ..... 84/422.1, 422.2, 422.3
See application file for complete search history.

(56) References Cited

U.S. PATENT DOCUMENTS 6,320,109 B1 * 11/2001 Kuppers ..... G10D 13/065 84/422.1

* cited by examiner

*Primary Examiner* — Kimberly Lockett

(57) ABSTRACT

A dual action pedal device utilizing the forward section of a musical bass drum pedal foot board to strike a musical bass drum and an attached heel controlled piston to open/close musical hi-hat cymbals. By pressing in a downward motion the heel of a human foot closes musical hi-hat cymbals under spring pressure. Upon raising a human foots heel from the aforementioned piston the hi-hat cymbals open under spring pressure thus making this device a dual action pedal.

3 Claims, 6 Drawing Sheets

FIGURE. 3
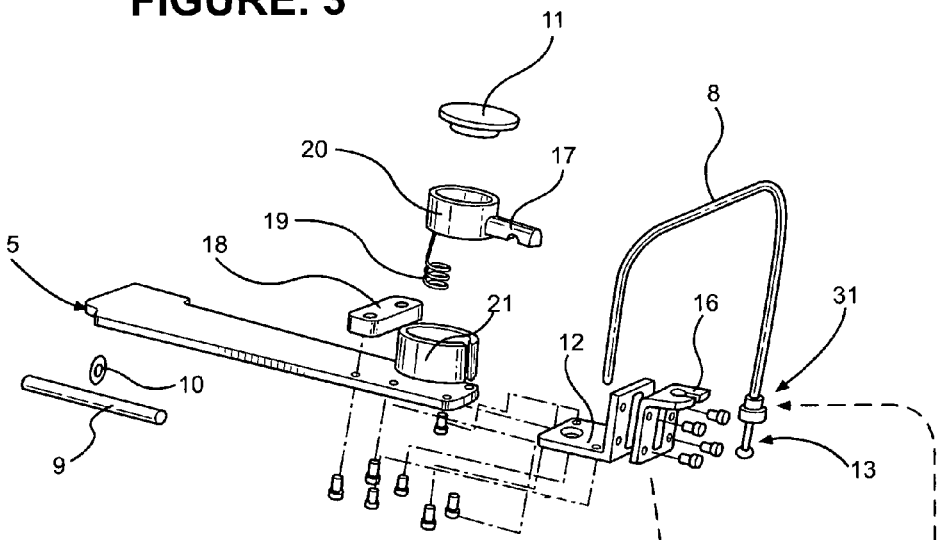
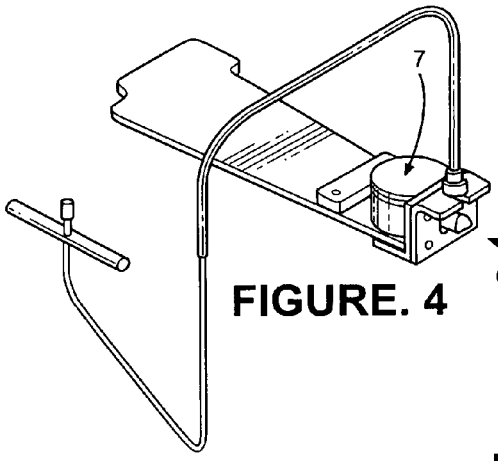
FIGURE. 4
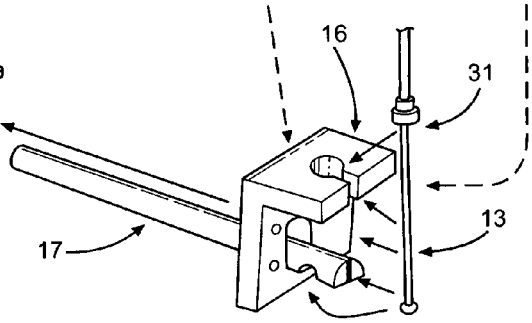
FIGURE. 4A

DUAL ACTION PEDAL DEVICE

BACKGROUND

The first single bass drum pedal was introduced in 1900. A bass drum pedal operates a footplate which is pressed to pull a chain, belt, or metal drive mechanism downward, bringing a beater or mallet forward into the drumhead. The beater head is usually made of either felt, wood, plastic, or rubber and is attached to a rod-shaped metal shaft. The pedal and beater system are mounted in a metal frame. A tension unit controls the amount of pressure needed to strike and the amount of recoil upon release.

This dual action pedal device is an improvement over a standard bass pedal as it provides many new percussive ideas to a drummer. The dual action pedal device was designed to provide a way of utilizing three actions with two feet on a dual set of musical bass drum pedals Also used in combination with the dual action pedal device is a drummers hi-hat. A hi-hat is a tubular metal structure standing vertically with a tube clamped inside a larger tube (for height adjustment purposes) which is pressed into a two tower base with area enough laterally between the towers to have a hi-hat center rod extending downward having a chain or link attached mechanically thereto which when pulled downward applies pressure to a foot board mounted between the towers. At the top of the said center rod is a cymbal mounted in its upward position being held open from a bottom cymbal by spring pressure. When the said foot board is pressed it pulls the upper and lower cymbals together as to create a clicking or splashing cymbal sound when struck with a drum stick. The purpose of this invention is to eliminate the said foot board and replace it with a section of the new dual action pedal device. In observation of drummers at clubs and concerts there was usually one foot on the right bass pedal of a double bass drum set and the other foot would operate the hi-hat with the exception of a solo or special musical segment.

There is a need to create what is now the dual action pedal device which combines the use of one foot to operate the bass drum with the forward section of a foot and the hi-hat with the heel section of a foot utilizing a spring loaded piston with a rod inserted which pulls a cable to close hi-hat cymbals and allows them to open under spring pressure upon lifting their heel. This way a drummer can operate two bass drums and still make use of the hi-hat at the same time.

The dual action of this device is what makes it superior over standard bass drum pedals.

SUMMARY OF THE INVENTION

The scope of this dual action pedal device is to provide a musical drum pedal which utilizes both the heel and the toe of a single human foot on one pedal to perform two actions. The toe depressing a foot board causes a beater to strike a musical bass drum and the heel of same said human foot presses on a piston to close hi-hat cymbals allowing the same said cymbals to open under spring pressure upon lifting the heel. This foot board/piston combination will make it much easier for drummers to operate two bass drum pedals and also be able to close and allow open hi-hat cymbals without having to move their foot from one pedal to another. There are also many new percussive beats which can be created by using this dual action pedal device. This pedal device can be used by right footed or left footed drummers. It can also be used by a person who has lost a foot or a leg yet still wants to learn how to play drums. This is made possible by having this pedal perform two actions with one human foot, the toe to operate a bass drum foot board and the heel to operate a piston device which closes hi-hat cymbals and allows them to open upon lifting.

BRIEF DESCRIPTION OF THE DRAWINGS

FIG. 2 A. displays hi-hat section of dual action pedal device.

FIG. 3. displays an exploded view of the parts of the dual action pedal device.

FIG. 4. displays the assembled view of FIG. 3.

FIG. 4 A. displays cable quick connect system.

DETAILED DESCRIPTION OF THE INVENTION

The use of this dual action musical drum pedal can be utilized in different fashions. As originally designed it is to be used with either a double bass musical drum set or a single bass musical drum set with a set of double pedals. It can also be utilized on a single pedal to play a musical drum set with one human foot performing two actions, leaving the other foot free to perform other percussive actions. There are many new types of beats that can be created with the toe and heel control of this pedal device. Drummers who perform with two bass drum pedals are using only one pedal batting the bass drum and the other pedal used is the one attached to the hi-hat in order to allow open hi-hat cymbals under spring pressure and to close the same aforementioned cymbals by pushing the hi-hat foot board downward with a human foot, thus leaving the secondary bass drum pedal unused except in the event of a drum solo or other temporary use.

With this pedal device a drummer can permanently keep their feet on both bass drum pedals and keep hi-hat cymbals closed only to allow a cymbal open position on command by lifting their heel.

Figure 1:
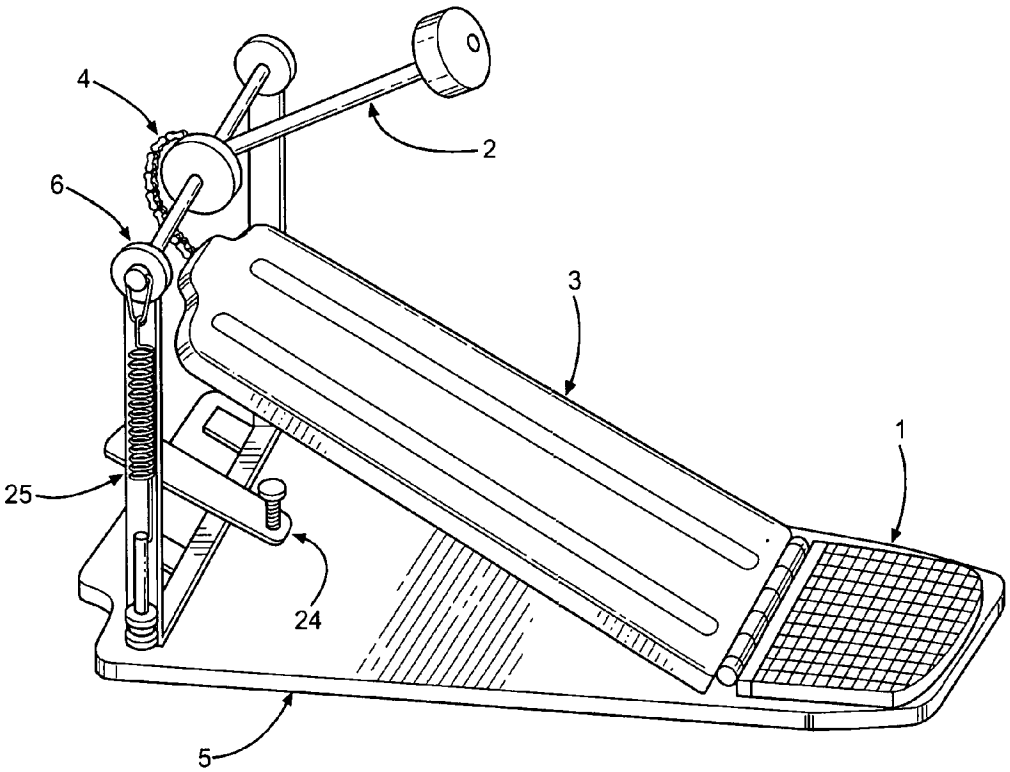
FIGURE. 1 PRIOR ART
FIG. 1. displays a prior art standard single bass drum pedal.

FIG. 1. displays a prior art bass drum pedal from which the dual action pedal device is designed. The heel rest 1 is the part which is removed to provide the area where the dual action pedal device piston/cylinder assembly will be installed. The bass drum beater 2 has been removed as not to be used with preferred use of dual action pedal device. The foot board 3 is that which is pressed downward to rotate base pedal rotating collar with pull chain attached 4 riding on bass pedal shaft bearings 6. Bass pedal foot board 3 is returned to upward position by foot board return spring 25. All items are mounted upon base pedal base plate 5 by tightening base plate clamp 24. Foot board return spring 25 is moved to right hand post of bass pedal support structure in order to allow clamping area for bracket assembly 33 from FIG. 2.

Figures 2, 2A:
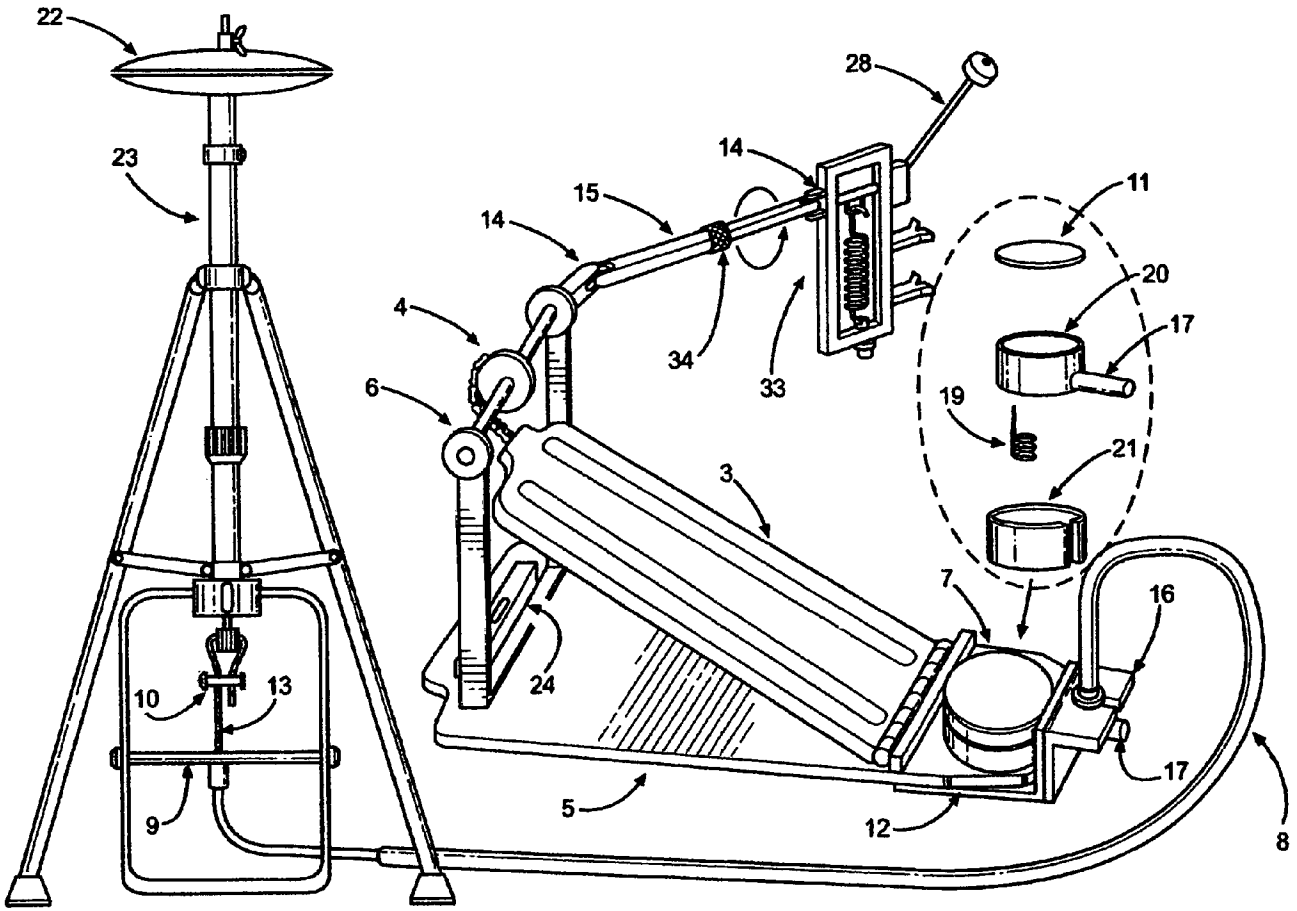
FIG. 2. is an adaptation to FIG. 1 which has the heel driven device and cable link attached to converted hi-hat. It also has the link to the mounted primary bass pedal.

FIG. 2. Displays actuator piston assembly 7 which comprises within dashed lines piston cylinder 21, actuator piston 20, drive cable actuator rod 17, actuator piston cap 11 and piston return spring 19. Actuator piston assembly 7 is mounted to bass pedal base plate 5 with two screws. Piston return spring 19 can also be magnetic resistance, air balloon or hydraulic pressure.

Primary "L" bracket 12 has secondary "L" bracket 16 mounted thereto and has drive cable actuator rod 17 passing through a slotted hole as to pull actuator cable 13 through actuator cable housing 8 which is flexible and leads to actuator cable housing support rod 9 which is mounted through two drilled holes in converted dual action pedal device hi-hat assembly 23. Actuator cable 13 is supported in place by actuator cable end clamp 10. Upon pressing actuator piston assembly 7, drive cable actuator rod 17 pulls actuator cable 13 through actuator cable housing 8 to pull closed open hi-hat cymbals under spring pressure. Pressing downward on bass pedal foot board 3 pulls a link which rotates bass pedal rotating collar 4 which rotates drive shaft 15 which has swivel provided by drive shaft universal joint 14. Shaft rotation is provided within bass drum shaft bearings 6. Bass pedal to base plate clamp 24 supports bass pedal to bass pedal base plate 5. Bass pedal foot board 3 is returned to upward position by a font board return spring which is housed inside a bracket assembly 33 which has a pivot provided by ball bearings on an axle that has a clamp which supports secondary bass pedal 28. Bracket assembly 33 is mounted to FIG. 1 prior art bass pedal left hand upright post.

FIG. 2 A displays hi-hat assembly 23 which has cable end support rod 9 having a hole drilled therein center to support actuator cable housing 8 allowing actuator cable 13 to pass through and loop horizontally through a nut at the bottom end of the hi-hat rod to be supported by actuator cable end clamp 10. While actuator cable 13 is shown to close and allow open hi-hat cymbals 22 under spring pressure, it is envisioned that actuator cable 13 can be used to actuate other musical and non musical devices. A hi-hat rod runs vertically through the hi-hit structure and supports the upper hi-hat cymbal of 22 under spring pressure. The aforementioned hi-hat rod is made of steel.

FIG. 3 displays an exploded view of dual action pedal device. Piston cylinder 21 is mounted to top side of base plate 5 Primary "L" bracket 12 is mounted to underside of bass pedal base plate 5 directly below piston cylinder 21. Secondary "L" bracket 16 is mounted to back of primary "L" bracket 12. Drive cable actuator rod 17 is held in place by a pin top return spring 19 within actuator piston 20. Foot board hinge support 18 is mounted in front of drive piston cylinder 21. Actuator cable housing 8 is mounted in a slot in secondary "L" bracket 16 and utilizes a flexible attachment to cable end support rod 9. Actuator cable 13 moves back and forth within actuator cable housing 8 to pull cable end stop 10 thus operating hi-hat. Actuator cable 13 and actuator cable housing 8 action can also be performed by hydraulic or pneumatic quick disconnect operation.

FIG. 4 displays all aforementioned FIG. 3 parts as they are assembled with actuator piston assembly 7 in place.

FIG. 4 A. displays how quick disconnect system works comprising drive cable actuator rod 17, actuator cable 13 and cable tension adjuster 31 being attached to secondary "L" bracket 16.

Figure 5:
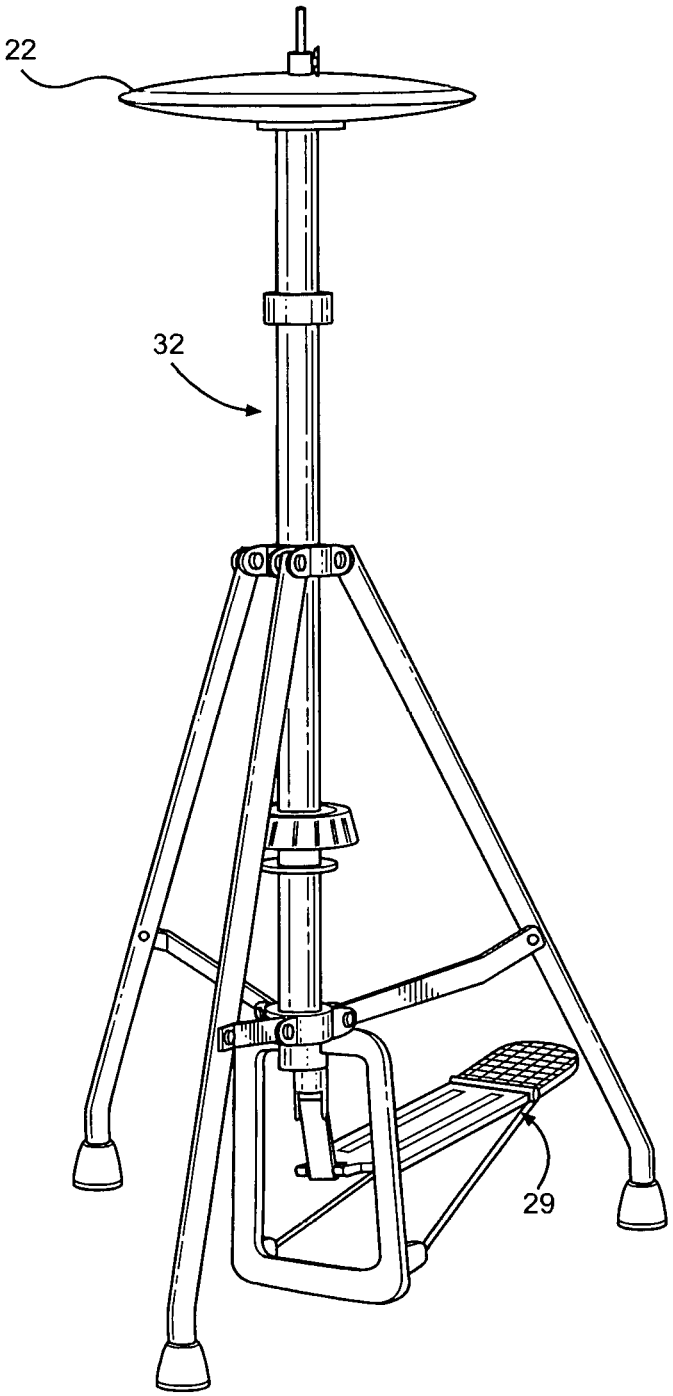
FIGURE. 5 PRIOR ART
FIG. 5. displays a prior art drummers hi-hat.

FIG. 5 displays a prior art hi-hat 32 with its foot board in place as used in standard drum playing which opens and closes hi-hat cymbals 22. Prior art foot board assembly 29 has been removed to make way for dual action pedal device adaptations.

Figure 6:
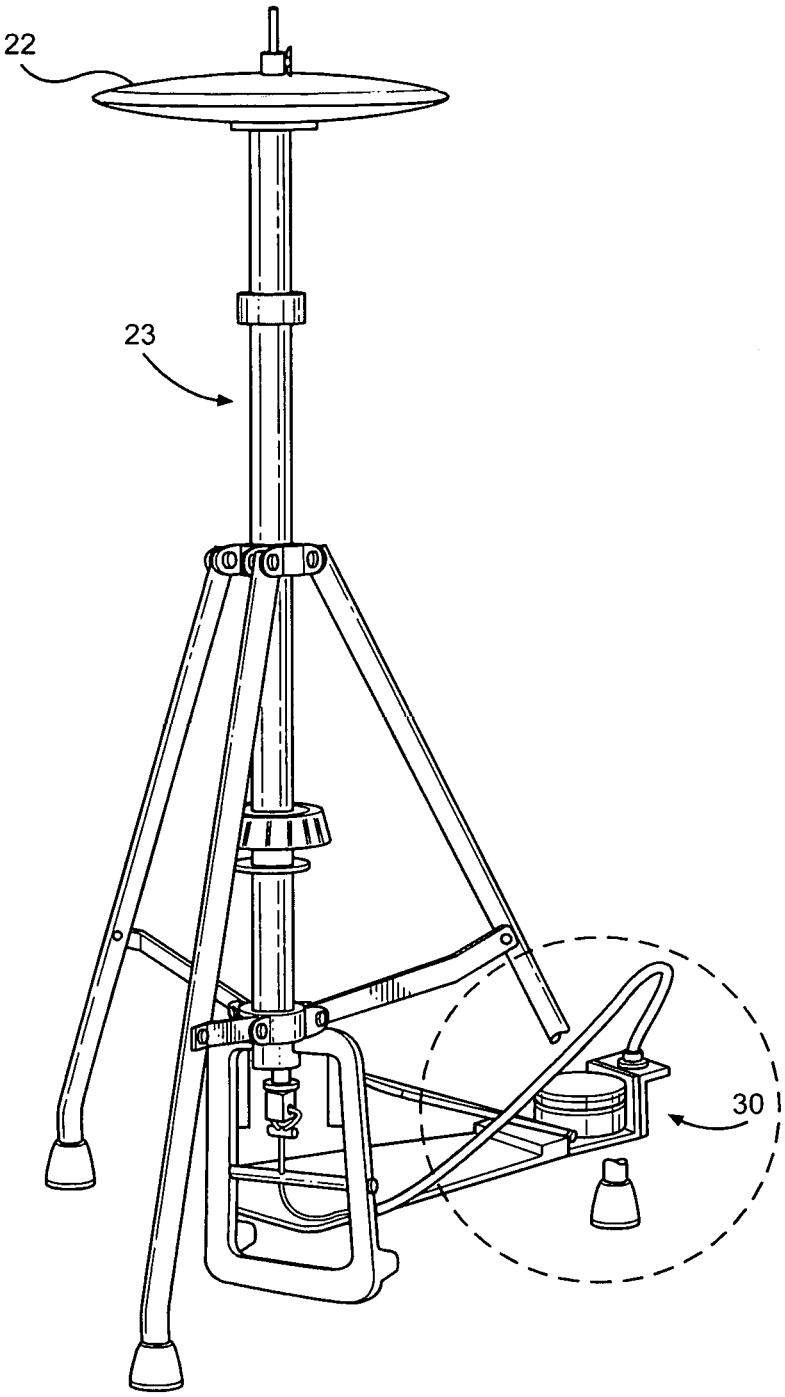
FIG. 6. displays the dual action pedal device linked to hi-hat with one leg cut away for view of actuator piston assembly.

FIG. 6 displays the same configuration as FIG. 5 with a cut-away of the hi-hat assembly 23 support leg 30 which passes by the dual action pedal device which utilizes the said actuator piston assembly 7 which operates hi-hat cymbals 22 opening and closing.

Figure 7:
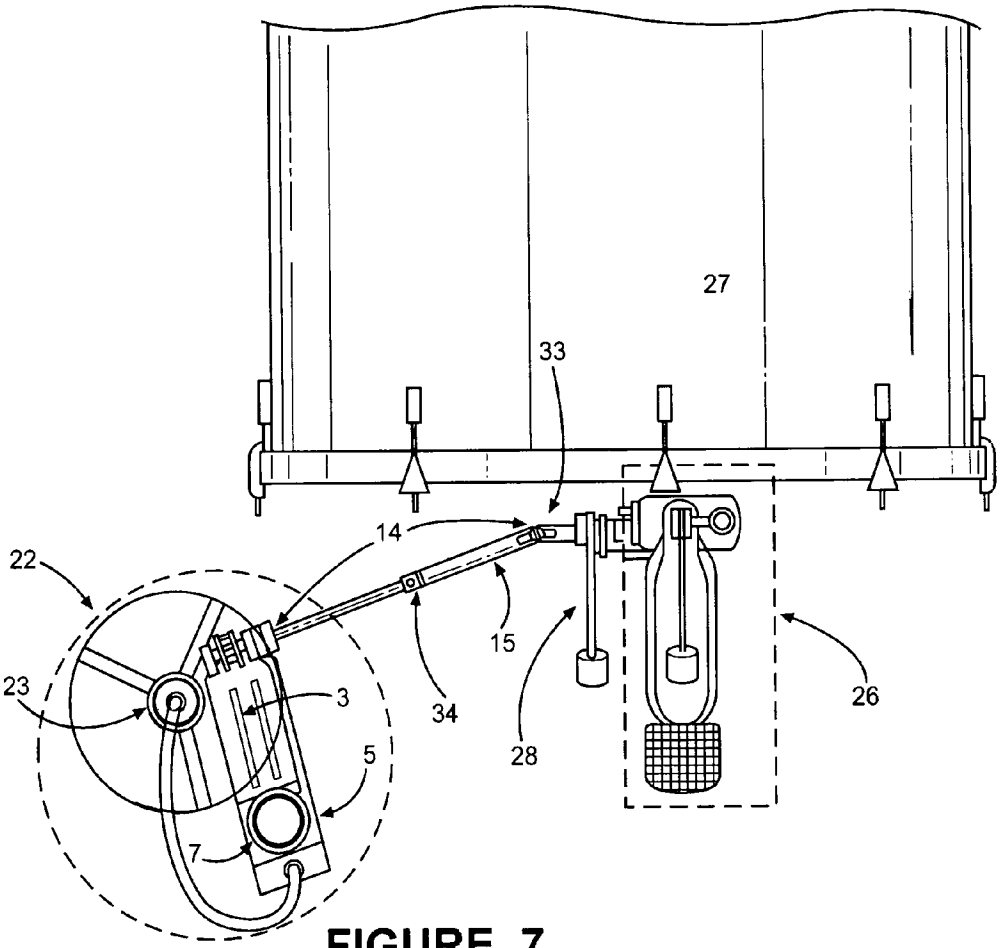
FIG. 7. displays top view showing operation with dual beater mounted bass pedal.

FIG. 7 displays a top view of a single bass drum 27 divided by rectangular section 26 from dual action pedal device mounted beater 28 which is mounted to bass pedal 26. Drive shaft 15 attaches to beater 28 swiveling on drive shaft universal joints 14 which rotate to have secondary beater 28 which is swivel mounted to bracket assembly 33 strike bass drum upon applying downward pressure to dual action pedal device foot board 3. Upon applying heel pressure to actuator piston assembly 7 hi hat cymbals 22 close under spring pressure which is built into dual action pedal device hi hat assembly 23. Hi-hat cymbals 22 are displayed transparent to display dual action pedal device below.

The invention claimed is:

1. A dual action musical device comprising a bass drum pedal foot board attached to a swivel, said swivel mounted to a base plate, said bass drum pedal foot board operated by an anterior section of a human foot to strike a batter against a base drum head, and a spring loaded piston within a cylinder, mounted to said base plate behind said base drum pedal foot board, said piston further comprising a rod inserted therein which pulls a cable through an affixed flexible cable housing stop rod to operate a musical hi-hat using a heel of said human foot.

2. A dual action musical device in accordance with claim 1, further comprising a hi-hat structure with two cymbals, said cymbals mounted on said hi-hat structure having two holes drilled horizontally through a bottom dual tower section of said hi-hat structure to mount said affixed flexible cable housing stop rod, said cable passes through a hole in said flexible cable housing stop rod to operate said hi-hat by pulling a vertical center rod of said hi-hat structure downward, thus closing said two cymbals together under spring pressure.

3. A dual-action musical device in accordance with claim 2, wherein said two cymbals mounted horizontally opposing each other, one cymbal mounted freely upon said hi-hat structure, and a second cymbal mounted securely and horizontally to said vertical center rod of said hi-hat structure, sustaining a spring loaded gap of ¼ to ½ inch between said two cymbals.

* * * * *